US006775509B2

(12) United States Patent
Shida et al.

(10) Patent No.: US 6,775,509 B2
(45) Date of Patent: Aug. 10, 2004

(54) IMAGE HEATING APPARATUS

(75) Inventors: Tomonori Shida, Shizuoka (JP); Akihiko Takeuchi, Shizuoka (JP); Masahiro Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/353,961

(22) Filed: Jan. 30, 2003

(65) Prior Publication Data

US 2003/0156866 A1 Aug. 21, 2003

(30) Foreign Application Priority Data

Feb. 1, 2002 (JP) ..... 2002-025263

(51) Int. Cl.[7] ..... G03G 15/20

(52) U.S. Cl. ..... 399/328; 219/216; 219/619; 399/330; 399/331

(58) Field of Search ..... 399/328, 330, 399/320, 331; 219/216, 619, 469

(56) References Cited

U.S. PATENT DOCUMENTS

| | | | | | |
|---|---|---|---|---|---|
| 323,789 | A | | 8/1885 | Chevallier | |
| 656,428 | A | | 8/1900 | Sherd | |
| 5,130,754 | A | * | 7/1992 | Hishikawa | |
| 5,319,430 | A | * | 6/1994 | DeBolt et al. | 399/331 |
| 5,331,385 | A | | 7/1994 | Ohtsuka et al. | |
| 5,355,204 | A | | 10/1994 | Aoki | |
| 5,450,181 | A | * | 9/1995 | Tsukida et al. | 399/328 |
| 5,543,904 | A | | 8/1996 | Kato et al. | |
| 5,568,240 | A | | 10/1996 | Ohtsuka | |
| 5,689,788 | A | * | 11/1997 | Moser | 399/328 |
| 5,778,293 | A | | 7/1998 | Ohtsuka | 399/329 |
| 5,889,610 | A | | 3/1999 | Fatehi | 399/302 |
| 6,049,691 | A | | 4/2000 | Abe et al. | 399/330 |
| 6,088,567 | A | | 7/2000 | Miyashiro et al. | 399/400 |
| 6,097,919 | A | | 8/2000 | Takeuchi et al. | 399/298 |
| 6,131,010 | A | | 10/2000 | Kume et al. | 399/333 |
| 6,151,477 | A | | 11/2000 | Takeuchi et al. | 399/318 |
| 6,229,982 | B1 | * | 5/2001 | Yamauchi et al. | 399/328 |
| 6,263,172 | B1 | | 7/2001 | Suzuki et al. | 399/67 |
| 6,347,211 | B2 | | 2/2002 | Nanataki et al. | 399/328 |
| 6,456,819 | B1 | | 9/2002 | Abe et al. | 399/329 |
| 6,473,574 | B1 | | 10/2002 | Usui et al. | 399/66 |
| 6,636,718 | B2 | * | 10/2003 | Yura et al. | 399/330 |
| 2002/0146259 | A1 | | 10/2002 | Zhou et al. | 399/329 |
| 2003/0007810 | A1 | | 1/2003 | Enomoto et al. | 399/302 |

FOREIGN PATENT DOCUMENTS

| | | | | | |
|---|---|---|---|---|---|
| JP | 7-114276 | | 5/1995 | | |
| JP | 09197864 | A | * | 7/1997 | G03G/15/20 |
| JP | 11024478 | A | * | 1/1999 | G03G/15/20 |
| JP | 11249478 | A | * | 9/1999 | G03G/15/20 |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a sliding member, and a pressure member which, together with the sliding member, forms a nip part, wherein a sliding surface of the nip part of the sliding member is crown shaped along a longitudinal direction of the sliding member, and the pressure roller is an inverse crown shape along the longitudinal direction. In accordance therewith, wrinkles in a recording material and springing-up of a conveying direction of the recording material can be suppressed.

7 Claims, 9 Drawing Sheets

IMAGE HEATING APPARATUS

BACKGROUND OF THE INVENTION

1. Field of the Invention

The present invention relates to an image heating apparatus which is suited for use as a heating fixing apparatus of an image forming apparatus using a recording technique such as an electrophotographic recording system, an electrostatic recording system, or the like, and in particular, to an image heating apparatus forming a nip part which nips a flexible rotating body therebetween and nip-conveys a recording material by a sliding member and a pressure roller.

2. Description of Related Art

For convenience, an example of an image heating apparatus (fixing apparatus), which is provided at an image forming apparatus such as a copier, a printer, or the like and which heat-fixes a toner image on a recording material, will be described.

In the image forming apparatus, a heat roller system apparatus has been broadly used as a fixing apparatus which heat-fixes, as a permanently fixed image and onto a recording material surface, an unfixed image (toner image) of object image information formed and borne by a transfer system or a direct system on a recording material (a transfer material sheet, an electro fax sheet, an electrostatic recording paper, an OHP sheet, a printing paper, a format paper, or the like) at a proper image forming process means section such as an electrophotographic process, an electrostatic recording process, a magnetic recording process, or the like.

Recently, from the standpoints of quick starting and saving energy, a film heating system apparatus has been put into practical use. Further, an electromagnetic induction heating system apparatus, in which a film itself generates heat, has been proposed.

In recent years, high speed has been strongly required of the fixing apparatus, and at the same time, making the image forming apparatus compact has been required. Further, the demand for color image forming apparatuses has increased. When a fixing roller and a pressure roller having small diameters are used to make an apparatus compact and the apparatus is a color image forming apparatus and the speed of conveying a recording material is fast, in order to permanently fix an unfixed toner image on a recording material surface, there is the need to apply a sufficient amount of heat and pressure to the recording material.

In a film heating system fixing apparatus having a metal layer, as compared with a resin film type fixing apparatus, there are features that the strength is high and the thermal conductivity is high, and it is easy to correspond to high-speed processing.

In Japanese Patent Application Laid-Open No. 7-114276, there is disclosed a heating apparatus which generates eddy current at a film itself or at a conductive member set close to the film, and heats by Joule heat.

This electromagnetic induction heating system can achieve an increase in the efficiency of consumed energy and also can correspond to high-speed processing, because the film itself is heated.

In a film heating system heating apparatus or an electromagnetic induction heating system heating apparatus using a film, as the method of driving a cylindrical or endless film shaped film serving as a rotating body, there are a method in which a film, which is pressed by a pressure roller and a film guide member guiding the film inner peripheral surface, is slave-rotated by rotation-driving the pressure roller (a pressure roller driving system), and conversely, a method in which the pressure roller is slave-rotated by driving of an endless film shaped film stretched between a drive roller and a tension roller.

However, in a heating fixing apparatus which uses a film having a metal layer as a rotating body, when a paper which is a recording material passes through the fixing apparatus, there are cases in which wrinkles arise at the paper at the fixing nip part. It is easy for wrinkles to arise in particular at thin papers.

Conventionally, in a heat roller system heating fixing apparatus which is generally used, by making the outside diameter of the fixing roller have an inverse crown shape, a force stretching a paper forward both sides is generated by making the paper conveying speed at the fixing nip part fast at the both edge parts and slow at the central part. A technique is thereby used which prevents the occurrence of paper wrinkles.

On the other hand, in the heating fixing apparatus which uses the film having a metal layer as a rotating body, it is difficult to make the fixing film corresponding to the heat roller to have an inverse crown shape. Further, the occurrence of paper wrinkles can be prevented by making an inverse crown shape at the sliding part of the fixing film and a fixing film guide member holding the fixing film. However, the shape of the fixing nip is an extreme central-concave shape, and troubles arise such as glossiness at the central portion of the image decreases or the like.

Further, when the force stretching the paper toward both sides in order to prevent paper wrinkles is too strong, there are cases in which the trailing edge of the paper springs up, and image defects such as rubbing or the like are caused.

SUMMARY OF THE INVENTION

The prevent invention has been achieved in consideration of the above-described problems, and an object of the present invention is to provide an image heating apparatus which can reduce wrinkles of a recording material and springing up of the conveying direction trailing edge of the recording material.

Another object of the present invention is to provide an image heating apparatus which can carry out uniform heating of an image while suppressing wrinkles of a recording material and springing up of the conveying direction trailing edge of the recording material.

Yet another object of the present invention is to provide an image heating apparatus comprising:

- a flexible rotating body (rotating member);
- a sliding member which is disposed at an interior of the rotating body and slides with the rotating body; and
- a pressure roller which, together with the sliding member, forms a nip part via the rotating body,
  - wherein a sliding surface of the nip part of the sliding member is crown shaped along a longitudinal direction of the sliding member, and the pressure roller is an inverse crown shape along the longitudinal direction, and between a crown amount cr per unit length of the crown shaped portion of the sliding member and an inverse crown amount cr' per unit length of the pressure roller, there is the relationship:

$$1.00\times10^{-3} \leqq cr-4cr'' \leqq 4.0\times10^{-3}.$$

Further objects of the present invention will become clear by reading the following detailed description while referring to the attached drawings.

DETAILED DESCRIPTION OF THE PREFERRED EMBODIMENTS (First Embodiment)

(1) Example of Image Forming Apparatus

Figure 1:
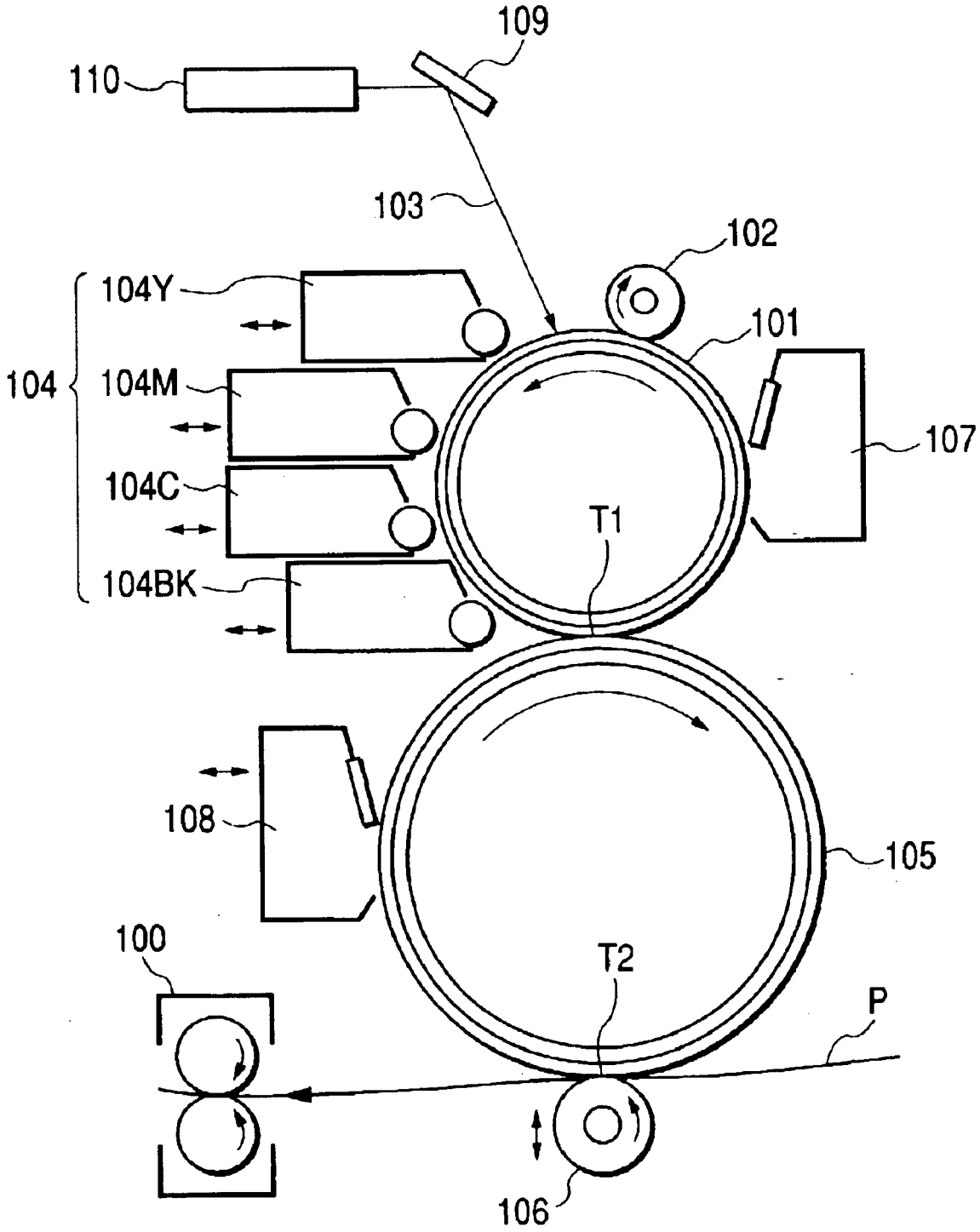
FIG. 1 is a schematic structural view of an image forming apparatus in which an image heating apparatus of the present invention is loaded.

FIG. 1 is a schematic structural view of an example of an image forming apparatus. The image forming apparatus of the present example is an electrophotographic color printer.

Reference numeral 101 is a photosensitive body drum (image bearing body) formed from an organic photosensitive body or an amorphous silicon photosensitive body, and is rotation-driven at a predetermined conveying speed (peripheral velocity) in the counterclockwise direction shown by the arrow. Further, the photosensitive body drum 101 is subjected to an charging processing, which has a predetermined polarity and whose electric potential is uniform, by an charging roller 102 in the rotating process.

Next, the charging processed surface is subject to scanning exposure processing of object image information by laser light 103 outputted from a laser optical box (laser scanner) 110. The laser optical box 110 outputs the laser light 103 converted into on and off in accordance with time series electrical digital pixel signals of the image information from an image signal generator such as an unillustrated image reading apparatus or the like, and scan-exposes the photosensitive body drum 101 surface. In accordance therewith, an electrostatic latent image corresponding to the image information is formed on the photosensitive body drum 101 surface. The outputted laser light from the laser optical box 110 is deflected to the exposure position of the photosensitive body drum 101 by a mirror 109.

In a case of forming a full-color image, scan-exposure and latent image formation for a first color separation component image in the object full-color image, for example, the yellow component image, are carried out. This latent image is developed as a yellow toner image by operation of a yellow developing device 104Y among four-color developing apparatuses 104. The yellow toner image is transferred onto an intermediate transfer drum 105 surface at a primary transfer part T1 which is a contacting part (or a proximity part) between the photosensitive body drum 101 and the intermediate transfer drum 105. The photosensitive body drum 101 surface, after the toner image has been transferred onto the intermediate transfer drum 105 surface, is cleaned by removing adhered residue such as the transferred residual toner or the like by a cleaner 107.

The process cycle of charging, scan-exposure, development, primary transfer, and cleaning as described above is sequentially executed for the respective color separation component images which are a second color separation component image (for example, a magenta component image, and a magenta developing device 104M works), a third color separation component image (for example, a cyan component image, and a cyan developing device 104C works), and a fourth color separation component image (for example, a black component image, and a black developing device 104Bk works) of the object full-color image. Four color toner images which are a yellow toner image, a magenta toner image, a cyan toner image, and a black toner image are sequentially superposed and transferred onto the intermediate transfer drum 105 surface, and a color toner image corresponding to the object full-color image is synthesized and formed.

The intermediate transfer drum 105 has an intermediate-resistance elastic layer and a high-resistance surface layer on a metal drum, and is rotation-driven in the clockwise direction shown by the arrow at a peripheral velocity which is the same as that of the photosensitive body drum 101 while contacting or being very close to the photosensitive body drum 101. A bias electric potential is applied to the metal drum of the intermediate transfer drum 105, and the toner image at the photosensitive drum 101 side is transferred to the intermediate transfer drum 105 surface side due to the a potential difference between the metal drum and the photosensitive body drum 101.

At a secondary transfer part T2 which is a contact nip part between the intermediate transfer drum 105 and a transferring roller 106, the above-described color toner image formed on the intermediate transfer drum 105 surface is transferred onto a surface of a recording material P fed at a predetermined timing from a paper feeding part (not shown) to the secondary transfer part T2. The transferring roller 106 collectively transfers the synthesized color toner image from the intermediate transfer drum 105 surface to the recording material P side by supplying toner and electric charges having a reverse polarity from a back surface of the recording material P.

The recording material P which has passed through the secondary transfer part T2 is separated from the intermediate transfer drum 105 surface and introduced into a fixing apparatus 100 which is an image heating apparatus. The unfixed toner image is heat-fixing-processed and becomes a fixed toner image, and the recording material P is discharged to an external paper discharge tray (not shown).

The intermediate transfer drum 105, after the color toner image has been transferred onto the recording material P, is cleaned by removing the adhered residue such as the transferred residual toner, paper powder or the like by a cleaner 108. The cleaner 108 is usually maintained in a non-contact state with the intermediate transfer drum 105, and is maintained in a contact state with the intermediate transfer drum 105 in the process of executing the secondary transfer of the color toner image onto the recording material P.

Further, the transferring roller 106 also is usually maintained in a non-contact state with the intermediate transfer drum 105, and is maintained in a contact state, via the recording material P, with the intermediate transfer drum 105 in the process of executing the secondary transfer of the color toner image onto the recording material P.

The image forming apparatus can also execute a printing mode of a monochromatic color image such as a black-and-white image or the like. Further, the image forming apparatus can execute a two-sided image printing mode or a multiple image printing mode.

In the case of the two-sided image printing mode, the recording material P, which is outputted from the fixing apparatus 100 and whose first surface an image has been printed is front-back reversed via a recirculating conveying mechanism (not shown), and is fed to the secondary transferring part T2 again. The second surface of the recording material P is subjected to toner image transfer, and the recording material P is introduced into the fixing apparatus 100 again, and is subjected to fixing processing of the toner image at the second surface. A two-sided image print is thereby outputted.

In the case of the multiple image printing mode, the recording material P, which was outputted from the fixing apparatus 100 and on whose first surface image has been printed, is not front-back reversed via the recirculating conveying mechanism (not shown), but is fed to the secondary transfer part T2 again. The recording material P is subjected to second toner image transfer on the surface on which the first image was printed, and is introduced into the fixing apparatus 100 again, and is subjected to fixing processing of the second toner image. A multiple image print is thereby outputted.

(2) Fixing Apparatus 100

In the present example, the fixing apparatus 100 is an electromagnetic induction heating system apparatus.

Figure 2:
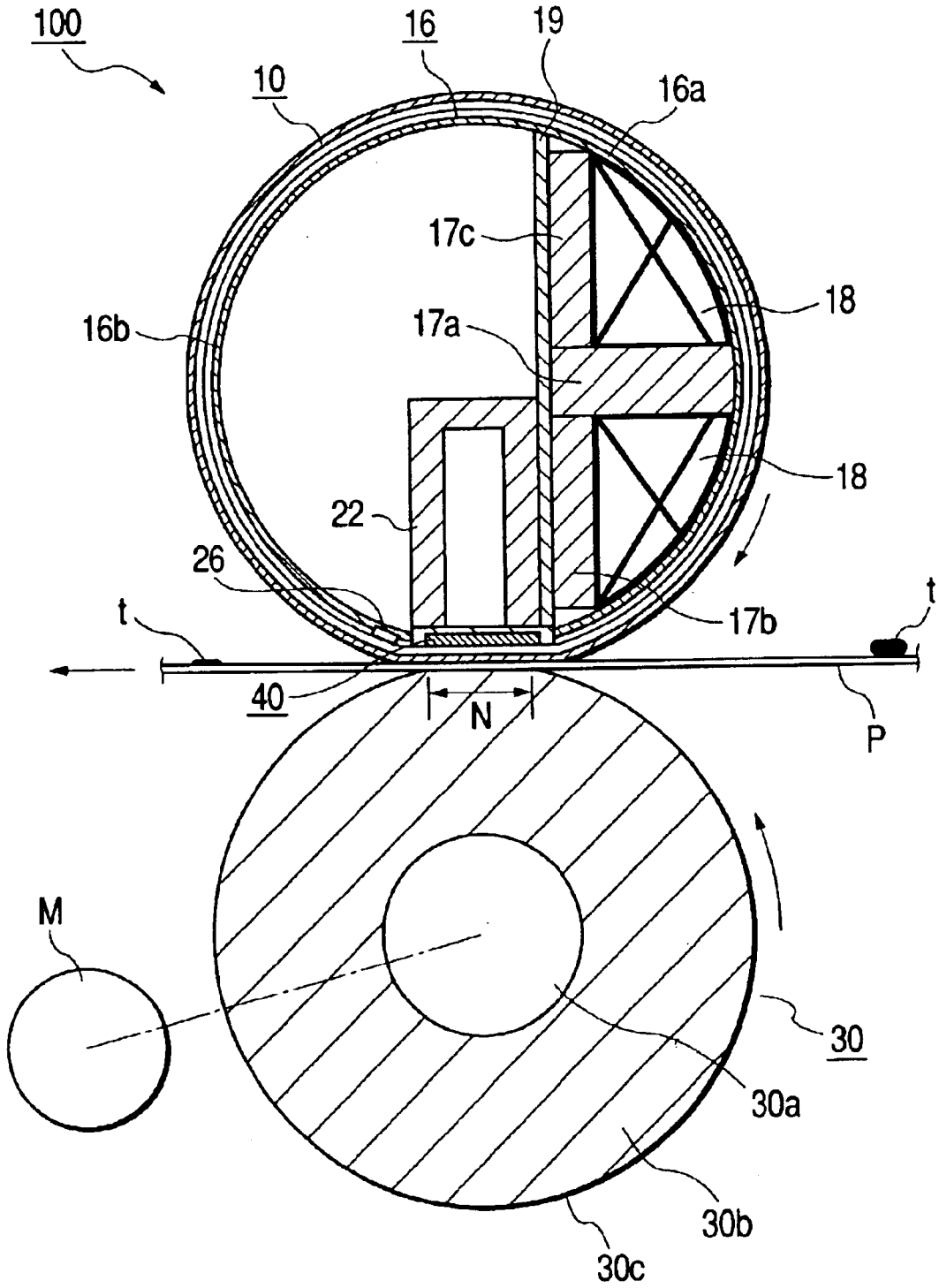
FIG. 2 is a cross-sectional side model view of main portions of the image heating apparatus.
Figure 3:
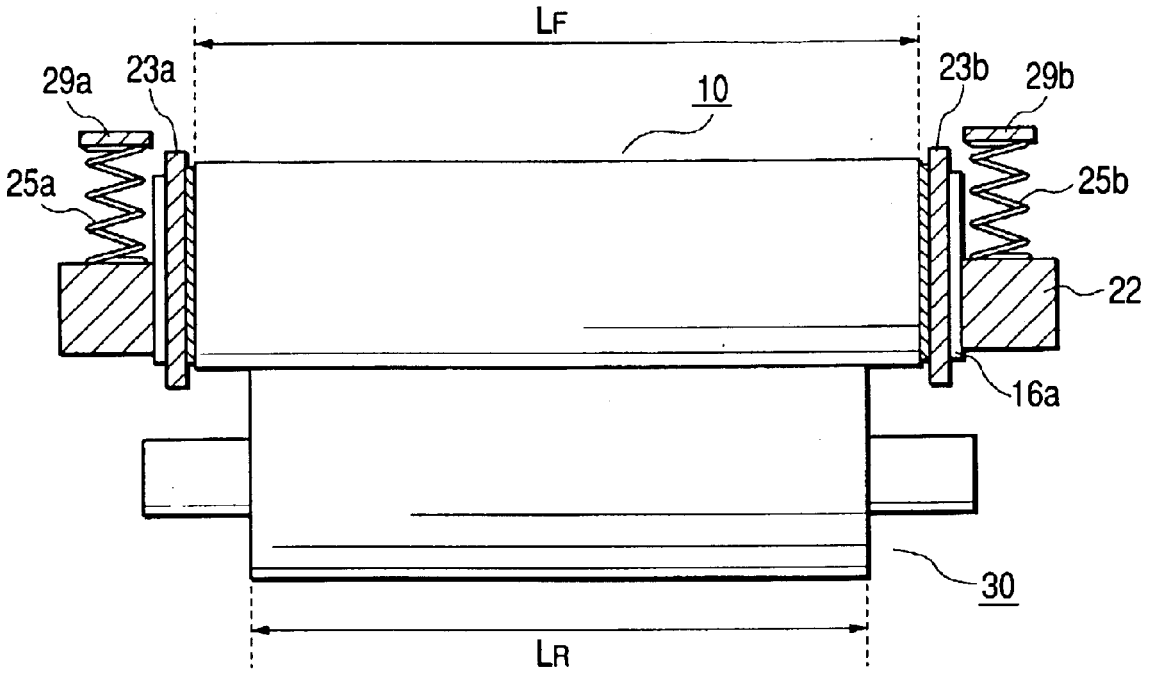
FIG. 3 is a front model view of the main portions of the image heating apparatus.
Figure 4:
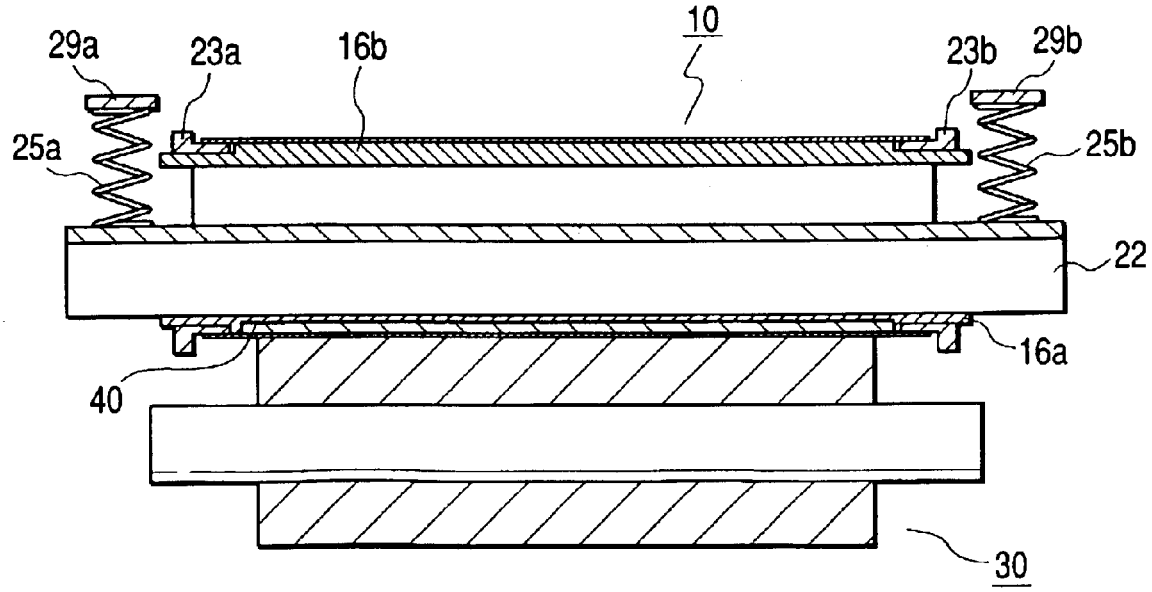
FIG. 4 is a cross-sectional front model view of the main portions of the image heating apparatus.

FIG. 2 is a cross-sectional model view of main portions of the fixing apparatus 100, and FIG. 3 is a front model view of the main portions, and FIG. 4 is a longitudinal sectional front model view of the main portions.

The apparatus 100 is largely formed from a film guide member (rotating body guide member) 16 serving as a rotating body supporting member which is cylindrical, a cylindrical electromagnetic induction heat generating fixing film 10 serving as a flexible rotating body which is loosely fit on the film guide member 16 from the exterior, and a pressure roller 30 serving as a pressure drive roller which forms a nip part N by nipping the fixing film 10 between the film guide member 16 and the pressure roller 30. In the present embodiment, the film guide member 16 corresponds to a sliding member sliding along the flexible rotating body 10.

The film guide member 16 which is cylindrical is structured as a cylindrical body by combining a left-and-right pair of trough-shaped half bodies 16*a* and 16*b*, whose cross sections are substantially semi-circular arc shaped, such that the openings thereof face one another. In FIG. 2, at the inner side of the right side film guide member half body 16*a*, magnetic cores 17*a*, 17*b*, 17*c* serving as magnetic field generating means and an exciting coil 18 are disposed and held.

The pressure roller 30 is structured from a core 30*a* and a heat resistant elastic material layer 30*b* which is molded and covered concentrically and integrally in a roller shape around the aforementioned core, such as a silicon rubber, a fluoro rubber, a fluorocarbon resin or the like. A separating layer 30*c* such as PFA, PTFE, FEP or the like may be formed at the periphery of the elastic body layer 30*b*. In the present embodiment, PFA is used as the separating layer 30*c*. Both edge parts of the core 30*a* are disposed so as to be bearing-held so as to freely rotate between unillustrated chassis side metal plates of the apparatus.

The product hardness of the pressure roller 30 in a molded state is Asker (TM) Durometer type C hardness (9.8 N load), and is 40° to 70°. In a pressure roller whose product hardness is too low, the fixing nip width formed by the press-contact between the fixing film and the pressure roller becomes too wide, and it is disadvantageous with respect to slipping of a medium. On the other hand, when the product hardness is too high, the fixing nip width becomes narrow, and the fixing performance deteriorates.

The film guide member 16 at which the fixing film 10 is fit at the outside thereof is disposed at the upper side of the pressure roller 30. By compressing and providing pressure springs 25*a*, 25*b* between both edge parts of a pressuring rigid stay 22 inserted through the interior of the film guide member 16 and spring bearing members 29*a*, 29*b* at the apparatus chassis side, push-down force is applied to the pressuring rigid stay 22. In accordance therewith, the lower surface (sliding surface) of the film guide member 16 and the upper surface of the pressure roller 30 nip and press-contact the fixing film 10, and the fixing nip part N having a predetermined width is formed.

The linear pressure applied to the nip part is 60 g/mm to 180 g/mm. When the linear pressure is too low, the driving force of the fixing film by the pressure roller 30 is insufficient, and it is easy for slipping of the medium to arise. On the contrary, when the linear pressure is too high, stick slipping arises at the sliding part between the inner surface of the fixing film and the film guide member, and image defects are caused.

The pressure roller 30 is rotation-driven in the counter-clockwise direction shown by the arrow by driving means M (FIG. 2). By the rotation-driving of the pressure roller 30, torque is applied to the fixing film 10 by frictional force between the pressure roller 30 and the outer surface of the fixing film 10 at the fixing nip part N. The fixing film 10 rotates the outer periphery of the film guide member 16 at a peripheral velocity substantially corresponding to the peripheral velocity of the pressure roller 30 in the clockwise direction shown by the arrow, while the inner peripheral surface of the fixing film 10 is sliding while closely contacting the lower surface of the film guide member 16 at the fixing nip part N (pressure roller driving system).

In order to reduce the mutual sliding frictional force between the lower surface of the film guide member 16*a* and the inner surface of the fixing film 10 at the fixing nip part N, a heat resistant/low-friction sliding member 40, which is a separate body from the film guide member 16*a*, may be provided at a surface portion corresponding to the fixing nip part N of the lower surface of the film guide member 16*a*. In this case, the low-friction sliding member 40 corresponds to the sliding member of the present invention. Further, a highly-slidable material is used as the film guide member 16*a*, and the sliding surface and the film guide member 16*a* may be formed as an integrated member. In this case, the film guide member 16*a* corresponds to the sliding member of the present invention. The sliding member 40 is preferably structured from, for example, polyimide resin, glass, alumina, a material in which alumina is coated with glass, or the like. In the present example, the material in which an alumina substrate is coated with glass is provided.

(3) Magnetic Field Generating Means

The magnetic cores 17*a*, 17*b*, 17*c* are members having high permeability. Materials used for cores of transformers such as ferrite, permalloy or the like are preferable, and ferrite in which there is little loss even if it is 100 kHz or more is more preferably used.

In the exciting coil 18 structuring the magnetic field generating means, a structure (bundled lines), in which a plurality of copper thin wires which are respectively insulating-coated one-by-one are combined, is used as the conductor (wire) structuring the coil (coil), and the exciting coil is formed by winding the bundle line a plurality of times. In the present example, the exciting coil is formed by winding 12 times.

As the coating member for carrying out the insulating coating, it is preferable to use a coating member having heat resistance in consideration of heat conduction due to the heat generation of the fixing film 10. For example, it suffices to use a coating member such as amide imido, polyimide or the like. In the present embodiment, a coating member formed from polyimide is used, and the heat resistance temperature is 220° C.

The degree of concentration of the magnetic field coil 18 may be improved by applying pressure from the exterior.

An insulating member 19 is disposed between the magnetic field generating means 17*a*, 17*b*, 17*c*, 18 and the pressuring rigid stay 22. As the material of the insulating member 19, a material which has excellent insulation performance and has good heat resistance is preferable. For example, it suffices to select phenolic resin, fluoro resin, polyimide resin, polyamide resin, polyamide imide resin, polyether ketone (PEEK) resin, polyether sulphone (PES) resin, polyphenylene sulphide (PPS) resin, PFA resin, PTFE resin, FEP resin, LCP resin or the like.

Figure 5:
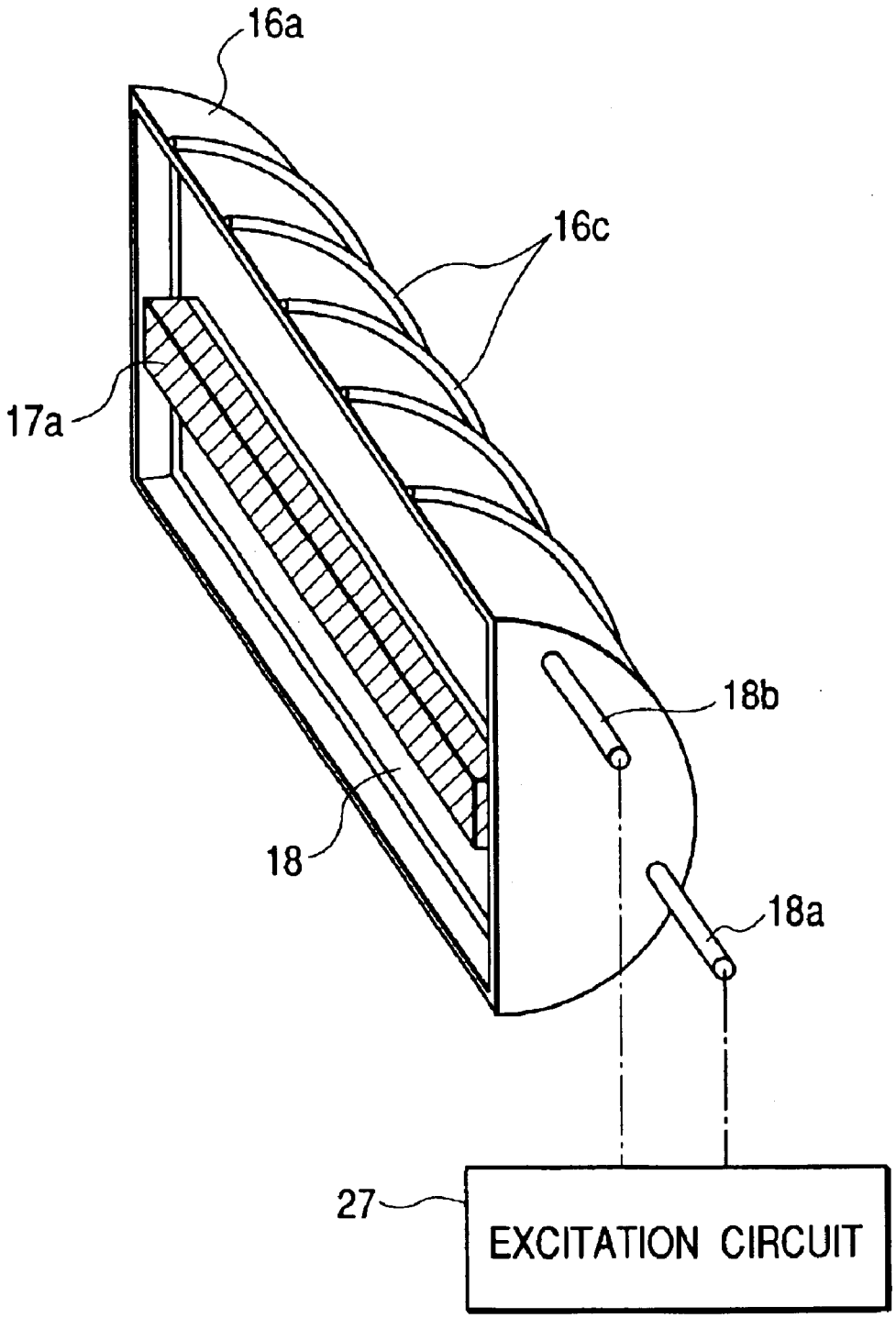
FIG. 5 is a perspective model view of a half body of a film guide member in which a magnetic field generating means is provided and supported in the interior thereof.

At the exciting coil 18, an excitation circuit 27 is connected to feeding parts 18*a*, 18*b* (FIG. 5). The excitation circuit 27 can generate high frequencies from 20 kHz to 500 kHz by a switching power source. The exciting coil 18 generates alternating magnetic flux by alternating current (high frequency current) supplied from the excitation circuit 27.

Figure 6:
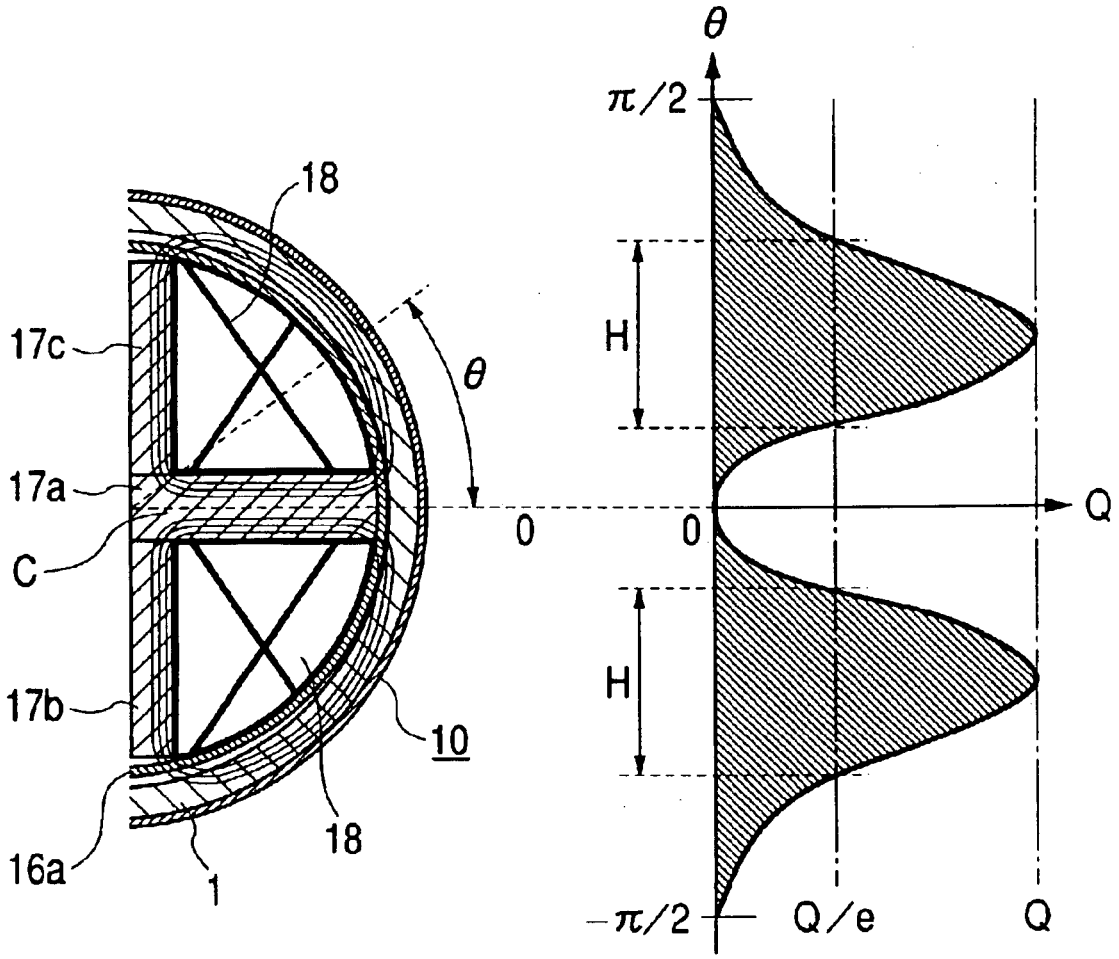
FIG. 6 is a view showing the relationship between the magnetic field generating means and a generated heat amount Q.

FIG. 6 typically shows a state of generating alternating magnetic flux generated by the magnetic field generating means. A magnetic flux C shows a part of the generated alternating magnetic flux. The alternating magnetic flux C introduced by the magnetic cores 17*a*, 17*b*, 17*c* generates eddy current at a heating layer 1 of the fixing film 10 between the magnetic core 17*a* and the magnetic core 17*b*, and between the magnetic core 17*a* and the magnetic core 17*c*. The eddy current generates Joule heat (eddy current loss) at the heating layer 1 by specific resistance of the heating layer 1.

A generated heat amount Q is determined by the density of the magnetic flux C passing through the heating layer 1, and exhibits the distribution of the graph of FIG. 6. In the graph shown in FIG. 6, the vertical axis shows positions in the circumferential direction at the fixing film 10 expressed by an angle θ with the center of the magnetic core 17*a* being 0, and the horizontal axis shows the generated heat amount Q at the heating layer 1 of the fixing film 10. Here, a heat generating area H is defined as an area in which the maximum generated heat amount is Q and the generated heat amount is greater than or equal to Q/e (e is the bottom of the natural logarithm). This is an area in which generated heat amounts necessary for the fixing process can be obtained.

The temperature of the fixing nip part N is controlled such that a predetermined temperature is maintained by controlling the current supply to the exciting coil 18 by a temperature control system (not shown) including temperature sensing means 26 (FIG. 2). The temperature sensing means 26 is a temperature sensor such as a thermistor or the like sensing the temperature of the fixing film 10. In the present example, the temperature of the fixing nip part N is controlled on the basis of temperature information of the fixing film 10 measured by the thermistor.

(4) Fixing Film (Flexible Rotating Body) 10

Figure 7:
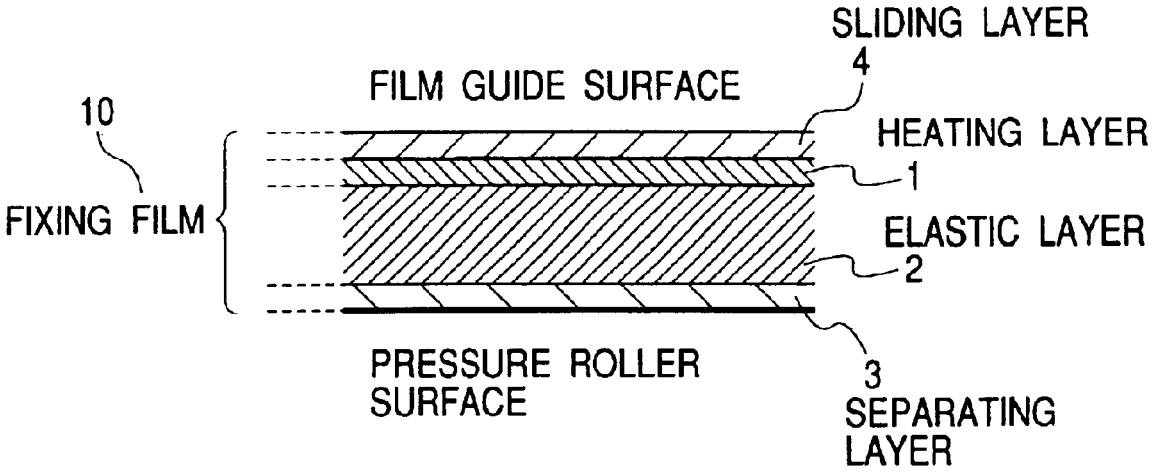
FIG. 7 is a layer structural model view of an electromagnetic induction heat generating fixing film.

FIG. 7 is a layer structural model view of the fixing film 10 in the present embodiment.

The fixing film 10 of the present embodiment is a composite structure of the heating layer 1 which is a base layer and is formed from an electromagnetic induction heat generating metal film or the like, the elastic layer 2 which is superposed on the outer surface of the heating layer 1, the separating layer 3 superposed on the outer surface of the elastic layer 2, and the sliding layer 4 superposed on the inner surface of the heating layer 1.

In order to adhere the heating layer 1 and the elastic layer 2 together, and to adhere the elastic layer 2 and the separating layer 3, and to adhere between the separating layer 3 and the sliding layer 4 together, primer layers (not shown) may be provided between the respective layers.

At the fixing film 10 which is substantially cylindrical, the sliding layer 4 is the inner side, and the separating layer 3 is the outer side.

As described above, by applying alternating magnetic flux to the heating layer 1, eddy current is generated at the heating layer 1, and the heating layer 1 generates heat. The heat is transmitted to the elastic layer 2 and the separating layer 3, and the entire fixing film 10 is heated. The recording material P fed to the fixing nip part N is heated, and heat-fixing of a toner image t is carried out.

a. Heating Layer 1

As the heating layer 1, a magnetic metal or a non-magnetic metal can be used. However, a magnetic metal is preferably used. As such a magnetic metal, a ferromagnetic body metal such as nickel, iron, ferromagnetic stainless steel, nickel-cobalt alloy, and permalloy is preferably used. Further, in order to prevent metal fatigue due to winding stress repeatedly applied at the time of rotating of the fixing film 10, a member in which manganese is added into nickel may be used.

The thickness of the heating layer 1 is preferably thicker than the depth a [m] of the surface covering expressed by the following formula, and is preferably less than or equal to 200 μm. If the thickness of the heating layer 1 is within this range, because the heating layer 1 can effectively absorb electromagnetic waves, it can efficiently generate heat:

$$\sigma=503\times(\rho/f\mu)^{1/2} \quad (1)$$

where, f is the frequency [Hz] of the excitation circuit, μ is the permeability of the heating layer 1, and ρ is the resistivity [Ω] of the heating layer 1.

Figure 8:
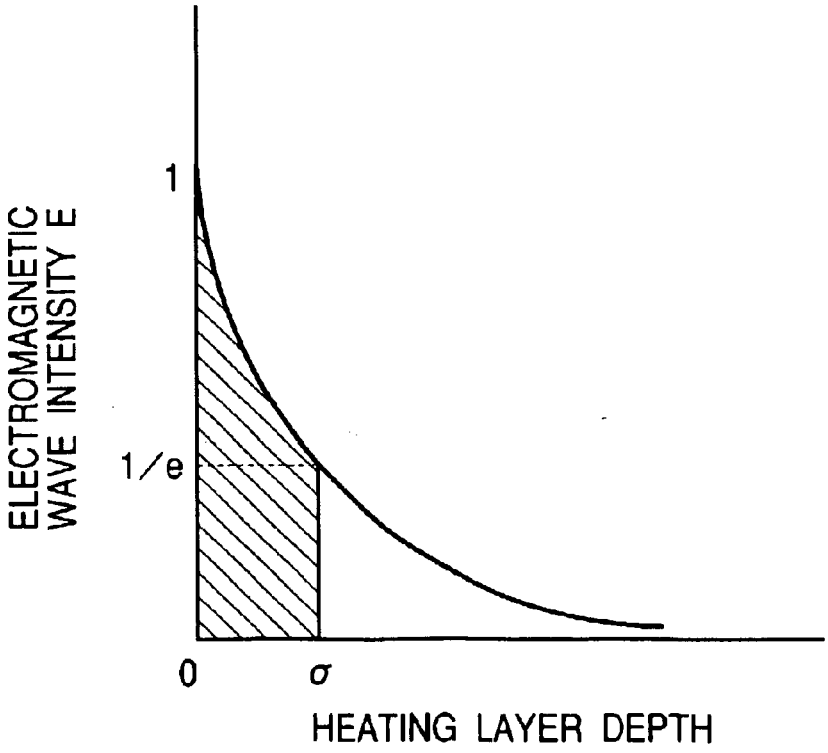
FIG. 8 is a graph showing the relationship between a depth of a heating layer and a strength of electromagnetic waves.

The surface covering depth σ shows the depth of absorption of electromagnetic waves used for electromagnetic induction, and the intensity of the electromagnetic waves is less than or equal to 1/e at depths deeper than σ. Conversely speaking, most of the energy is absorbed until this depth (refer to the relationship between heating layer depth and electromagnetic wave intensity shown in FIG. 8).

The thickness of the heating layer 1 is more preferably 1 to 100 μm. When the thickness of the heating layer 1 is thinner than the aforementioned range, it is not efficient because most of the electromagnetic energy cannot be absorbed. Further, when the heating layer 1 is thicker than the aforementioned range, the rigidity of the heating layer 1 is too high and the bendability is poor, and it is not practical for the heating layer 1 to be used as a rotating body.

b. Elastic Layer 2

As the elastic layer 2, a material whose heat resistance and heat conductivity are high, such as silicon rubber, fluoro rubber, fluoro silicon rubber or the like, is preferably used.

The thickness of the elastic layer 2 is preferably 10 to 500 μm in order to ensure the fixed image quality. When a color image is printed, particularly in a photographic image or the like, a solid image is formed over large surface area on the recording material P. In this case, if the heating surface (the separating layer 3) cannot follow the convexoconcavity of the recording material P or the convexoconcavity of the toner layer t, non-uniform heating arises, and non-uniform glossiness arises in the image at portions where the heat transfer amount is high and portions where the heat transfer amount is low. Namely, glossiness is high at the portions where the heat transfer amount is low, and glossiness is low at a part of little heat transfer amount. When the thickness of the elastic layer 2 is less than the above-described range, the separating layer 3 cannot follow the convexoconcavity of the recording material P or the toner layer t, and non-uniform image glossiness arises. Further, when the elastic layer 2 is too much lager than the above-described range, the thermal resistance of the elastic layer 2 is too high, and it is difficult to realize a quick start. The thickness of the elastic layer 2 is more preferably 50 to 500 μm.

If the hardness of the elastic layer 2 is too high, the elastic layer 2 cannot follow the convexoconcavity of the recording material P or the toner layer t, and non-uniform image glossiness arises. Therefore, the hardness of the elastic layer 2 is preferably less than or equal to 60° (JIS-A), and is more preferably less than or equal to 45° (JIS-A).

The thermal conductivity λ of the elastic layer 2 is preferably $2.5\times10^{-1}$ to $8.4\times10^{-1}$W/m·°C. When the thermal conductivity λ is less than the aforementioned range, the thermal resistance is too high, and the rise in temperature at the surface layer (separating layer 3) of the fixing film 10 is slow. When the thermal conductivity λ is greater than the aforementioned range, the hardness of the elastic layer 2 is too high or it is easy for compression set to arise. The hardness of the elastic layer 2 is more preferably $3.3\times10^{-1}$ to $6.3\times10^{-1}$ W/m·°C.

c. Separating Layer 3

As the separating layer 3, a material having good separating performance and heat resistance, such as a fluoro resin, silicon resin, fluoro silicon rubber, fluoro rubber, silicon rubber, PFA, PTFE, FEP or the like, is preferably used.

The thickness of the separating layer 3 is preferably 1 to 100 μm. When the thickness of the separating layer 3 is thinner than the aforementioned range, non-uniform coating of the coated film arises, and problems arise in that portions whose mold releasing performance is low arise and the durability is insufficient. Further, when the thickness of the separating layer 3 is thicker than the aforementioned range, heat conduction deteriorates. In particular, when a resin material is used as the separating layer 3, the hardness of the separating layer 3 is too high, and the effect of the elastic layer 2 is lost. Therefore, sliding resistance with the fixing film 10 can be reduced.

d. Sliding Layer 4

As shown in FIG. 7, in a structure of the fixing film 10, the sliding layer 4 is provided at the surface of the heating layer 1 opposite the surface at which the elastic layer 2 is provided.

As the sliding layer 4, a resin having high sliding performance and having heat resistance such as fluoro resin, polyimide resin, polyamide resin, polyamide imide resin, PEEK resin, PES resin, PPS resin, PFA resin, PTFE resin, FEP resin, or the like is preferable.

Due to the sliding layer 4 being provided, in addition to being able to keep the rotation-driving torque (torque at a pressure roller shaft serving as a drive roller) low at the initial stages of use of the fixing apparatus 100, wear of the heating layer 1 of the fixing film 10 can be prevented. Therefore, even if the fixing apparatus 100 is used for a long time, a rise in the rotation-driving torque can be suppressed.

Because the sliding layer 4 has the effect of insulating such that the heat generated at the heating layer 1 is not directed toward the inner side of the fixing film, as compared with a case in which there is no sliding layer 4, the heat supplying efficiency to the recording material P side is improved. Therefore, electric power consumption can be reduced.

Further, the thickness of the sliding layer 4 is preferably 10 to 1000 μm. When the thickness of the sliding layer 4 is less than 10 μm, the durability is insufficient, and in addition, the heat insulating ability is poor. On the other hand, when the thickness of the sliding layer 4 exceeds 1000 μm, the distance of the heating layer 1 from the magnetic core 17 and the exciting coil 18 is long, and the magnetic flux is not sufficiently absorbed into the heating layer 1.

Figure 10:
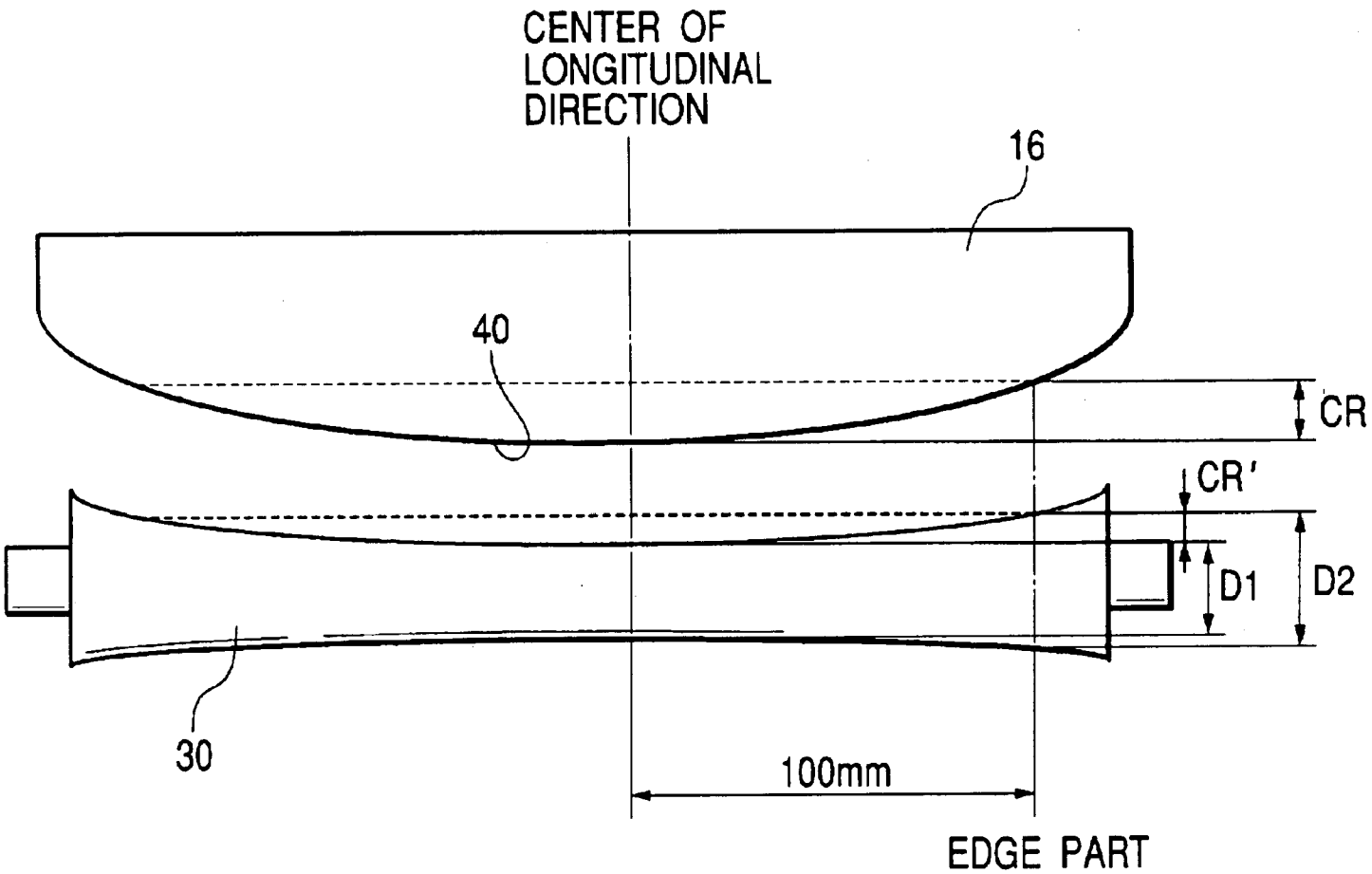
FIG. 10 is a front view 2 of the film guide member and the pressure roller.

(5) Countermeasures for Preventing Occurrence of Paper Wrinkles and Trailing Edge Spring-Up of the Recording Material In the present embodiment, as shown in FIG. 10, at the film guide member (sliding member) 16, the surface at the fixing nip surface side is not flat in the longitudinal direction, and has a downwardly convex positive crown shape. The positive crown amount of the film guide member 16 is expressed as CR, and the film guide member 16 swells to a height of CR at the maximum part, with respect to the straight line shown by the dotted line. In the present embodiment, the magnitude of the positive crown amount CR is set to 600 μm. Note that the sliding member 40 is adhered to the film guide member 16, and the sliding member 40 as well is made in a positive crown shape following the surface shape of the film guide member 16. In the present embodiment, the measurement position of the edge part is a position which is 100 mm from the center, and for convenience, it is described by using a height difference CR between the longitudinal direction central part and the edge part.

In the same way, with respect to the pressure roller 30 as well, the measurement position of the edge part is a position which is 100 mm from the longitudinal direction center, and the inverse crown amount is described as CR'.

Figure 9:
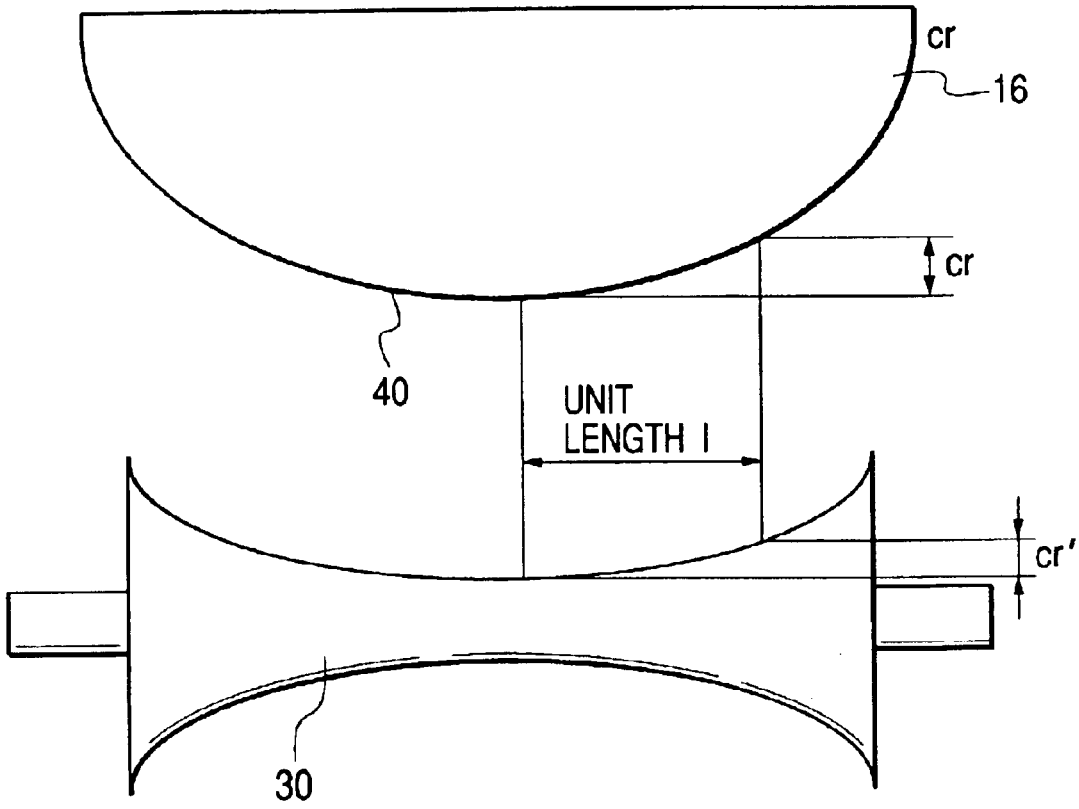
FIG. 9 is a front view 1 of the film guide member and a pressure roller.

The relationship between a positive crown amount cr per unit length (refer to FIG. 9) and CR used in the present embodiment is $$100\times1000\ cr=CR\ (\mu m)$$

because the position of the edge part is a position which is 100 mm from the center.

Further, the relationship between the inverse crown amount cr' per unit length (refer to FIG. 9) and CR' used in the present embodiment is $$100\times1000\ cr'=CR'\ (\mu m)$$

because the position of the edge part is a position which is 100 mm from the center.

A method of measuring the positive crown amount CR of the film guide member 16 will be described.

The top and bottom of the film guide member 16 are reversed, and the film guide member 16 is placed on a horizontal surface plate, and the surface of the sliding member 40 is measured by a height gauge. Further, with respect to the pressure roller 30, the inverse crown amount is measured by a laser outside diameter length measuring machine.

The positive crown amount CR of the film guide member 16 is defined as a difference between the heights of the longitudinal direction central part and the longitudinal edge part (a position which is 100 mm from the center) at the fixing nip surface side of the film guide member 16. The inverse crown amount CR' of the pressure roller 30 is defined as (D2−D1)/2 from the difference between the outside diameter D1 of the longitudinal direction central part of the pressure roller 30 and the outside diameter D2 of the edge part (a position which is 100 mm from the center). Note that, in the present embodiment, the inverse crown amount CR' of the pressure roller 30 is set to 100 μm.

As described above, in the present embodiment, the fixing nip surface of the film guide member 16 is set to be a positive crown shape, and the pressure roller 30 is set to be an inverse crown shape. The relationship between the magnitudes of the positive crown amount CR of the film guide member 16 and the inverse crown amount CR' of the pressure roller 30, and the occurrence of paper wrinkles and springing-up of the trailing edge of the recording material P is shown in the table.

Note that, because the film guide member 16 and the pressure roller 30 are pressured at the both edges, the film guide member 16 which is formed of resin is bent in a direction of eliminating positive crown, and the core 30*a* of the pressure roller 30 is bent in a direction of increasing the inverse crown. Accordingly, even when the positive crown CR of the film guide member 16 is 0 μm and the inverse crown CR' of the pressure roller 30 is 0 μm, the shape of the nip is not uniform in the longitudinal direction, and is a centrally concave nip in which the longitudinal direction center is more concave than the edge parts. Taking this shape as a reference, the larger the positive crown amount of the film guide member 16 is, the wider the width of the longitudinal direction central part of the nip part is. On the contrary, the larger the inverse crown amount of the pressure roller 30 is, the thinner the width of the longitudinal direction central part of the nip part is.

In the present experiment, a paper of 64 g/m$^2$ was used as the recording material P in an environment in which the temperature was 30° C. and a humidity was 80%. ○ denotes a good state in which there are no paper wrinkles and springing-up of the trailing edge, Δdenotes a state in which some paper wrinkles or some trailing edge springing-up arises, and x denotes a state in which paper wrinkles or springing-up of the trailing edge arises in this table.

TABLE 1

| | | Pressure roller inverse crown amount CR' (μm) | | | | | |
|---|---|---|---|---|---|---|---|
| | | 0 | 25 | 50 | 75 | 100 | 125 |
| Film guide crown amount CR (μm) | 800 | X | X | X | X | Δ | ○ |
| | 750 | X | Paper wrinkles | X | Δ | ○ | ○ |
| | 700 | X | X | X | ○ | ○ | ○ |
| | 650 | X | Δ | Δ | ○ | ○ | ○ |
| | 600 | X | Δ | Δ | ○ | ○ | ○ |
| | 550 | X | Δ | ○ | ○ | ○ | Δ |
| | 500 | X | ○ | ○ | ○ | ○ | Δ |
| | 450 | Δ | ○ | ○ | ○ | Δ | X |
| | 400 | ○ | ○ | ○ | ○ | Δ | X |

TABLE 1-continued

| | Pressure roller inverse crown amount CR' (μm) | | | | | |
|---|---|---|---|---|---|---|
| | 0 | 25 | 50 | 75 | 100 | 125 |
| 350 | ○ | ○ | ○ | ○ | Δ | X |
| 300 | ○ | ○ | ○ | Δ | X | X |
| 250 | ○ | ○ | ○ | X | X | X |
| 200 | ○ | ○ | Δ | X | X | X |
| 150 | ○ | ○ | Δ | X | X | X |
| 100 | ○ | ○ | X | X | X | X |
| 50 | ○ | Δ | X | X | X | X |
| 0 | ○ | Δ | X | X | X | X |
| −50 | ○ | Δ | X | X | Springing-up of railing edge | X |
| −100 | Δ | X | X | X | X | X |
| −150 | Δ | X | X | X | X | X |
| −200 | X | X | X | X | X | X |

In accordance with Table 1, it can be understood that there are regions in which both paper wrinkles and springing-up of the trailing edge do not arise.

Specifically, an example of a case in which the inverse crown of the pressure roller 30 is 75 μm will be described as an example by comparing times when the positive crown amount CR of the film guide member 16 is 300 μm, 500 μm, 750 μm.

By making the positive crown amount CR of the film guide member 16 be from 500 μm to 300 μm, although paper wrinkles do not arise, the level of trailing edge springing-up deteriorates. On the other hand, by making the positive crown amount CR of the film guide member 16 be from 500 μm to 750 μm, trailing edge springing-up does not arise, and paper wrinkles rarely arise.

When the positive crown amount CR is 500 μm, by appropriately pulling the paper toward both sides, paper wrinkles are prevented, and trailing edge springing-up is suppressed to a level which does not affect the image.

As the principle of the results of Table 1, when the positive crown amount CR of the film guide member 16 exceeds the allowable value with respect to the inverse crown amount CR' of the pressure roller 30, the press-contact force between the film guide member 16 and the pressure roller 30 via the fixing film 10 at the longitudinal direction central part is too large with respect to the edge part, and the conveying force of the central part increases. Therefore, it is disadvantageous with respect to paper wrinkles.

Conversely, when the positive crown amount CR is less than an allowable value with respect to the inverse crown amount CR', the press-contact force between the film guide member 16 and the pressure roller 30 at the edge part is too large with respect to the longitudinal direction central part, and the conveying force of the edge part increases, the paper is pulled more toward both sides. Thus, although paper wrinkles can be prevented, trailing edge springing-up and image defects accompanying this springing-up arise.

From the results of Table 1, at least when the edge part measuring position is 100 mm from the center, at the time of using a combination of the film guide member 16 and the pressure roller 30 satisfying $$100(\mu m) \leqq CR - 4\ CR' \leqq 400(\mu m),$$

a good image in which there are no paper wrinkles and trailing edge springing-up is obtained.

Next, fixing performance of the image when values are set to a crown amount CR of the film guide member 16 and an inverse crown amount CR' of the pressure roller 30, at which both paper wrinkles and trailing edge springing-up are substantially good and which are obtained from the results of Table 1, will be verified.

Figure 11:
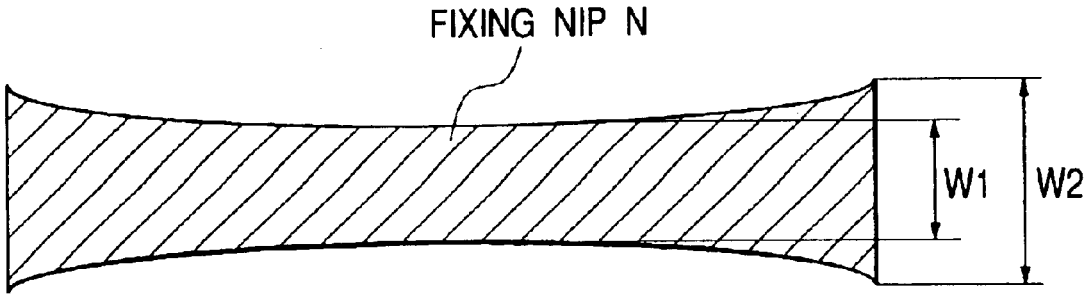
FIG. 11 is a explanatory view of the fixing nip of the image heating apparatus.

First, the shape of the nip part when values are set to a crown amount CR of the film guide member 16 and an inverse crown amount CR' of the pressure roller 30, at which both paper wrinkles and trailing edge springing-up are substantially good and which are obtained from the results of Table 1, will be described hereinafter. For example, when values are set to CR=600 μm, CR'=100 μm, the shape of the fixing nip N is a shape such as shown in FIG. 11, in the axial direction of the pressure roller 30. The reason why the nip width of the longitudinal direction edge part is wider than that of the central part in spite of the fact that the crown amount CR of the film guide member 16 is greater than the inverse crown amount CR' of the pressure roller 30, is that the film guide member 16 and the pressure roller 30 are pressured at the both edges as described above. The fixing nip width affects the fixing performance and the like.

The relationship between the magnitudes of the positive crown amount CR of the film guide member 16 and the inverse crown amount CR' of the pressure roller 30, and the fixing nip width is shown in Table 2.

However, the numeric values in the table are numeric values in which the nip width W1 of the central part is subtracted from the nip width W2 of the longitudinal direction edge part (a position which is 100 mm from the center).

Table 2

TABLE 2

| | | Pressure roller inverse crown amount CR' (μm) | | | | | |
|---|---|---|---|---|---|---|---|
| | | 0 | 25 | 50 | 75 | 100 | 125 |
| Film guide crown amount CR (μm) | 800 | | | | | −0.7 | −0.7 |
| | 750 | | | | −0.6 | −0.5 | −0.4 |
| | 700 | | | | −0.5 | −0.4 | −0.2 |
| | 650 | | | −0.4 | −0.3 | −0.2 | 0 |
| | 600 | | | −0.2 | −0.1 | 0.1 | 0.2 |
| | 550 | | | 0 | 0.2 | 0.3 | 0.4 |
| | 500 | | 0.1 | 0.2 | 0.4 | 0.5 | |
| | 450 | 0.1 | 0.2 | 0.4 | 0.5 | 0.6 | |
| | 400 | 0.4 | 0.5 | 0.6 | 0.7 | | |
| | 350 | 0.4 | 0.6 | 0.7 | 0.8 | | |
| | 300 | 0.5 | 0.7 | 0.8 | 0.9 | | |
| | 250 | 0.6 | 0.8 | 1.0 | | | |
| | 200 | 0.8 | 1.0 | 1.2 | | | |
| | 150 | 1.1 | 1.2 | | | | |
| | 100 | 1.2 | 1.4 | | | | |
| | 50 | 1.5 | 1.7 | | | | |
| | 0 | 1.8 | | | | | |
| | −50 | 2.0 | | | | | |
| | −100 | | | | | | |
| | −150 | | | | | | |
| | −200 | | | | | | |

The setting distribution (the distribution of circles in Table 1) of CR, CR' at which both paper wrinkles and trailing edge springing-up are good, is as per above Table 1. However, in the setting distribution in which both paper wrinkles and trailing edge springing-up are good, as shown in Table 2, it can be understood that the greater CR' is, the more settings arise in which a minus value of a large value, namely, the width W1 of the longitudinal direction center of the nip part, is greater than the width W2 of the edge part. Conversely, minus values do not appear at regions at which CR' is small (0 μm or 25 μm). Namely, it can be understood that, in order to satisfy both paper wrinkles and trailing edge springing-up, the greater the CR' is, the wider the width of the longitudinal direction central part of the nip part must be.

However, when the inverse crown amount CR' of the pressure roller 30 is 0 μm, even if the crown amount CR of the film guide member 16 is 0 μm, occurrence of paper wrinkles and trailing edge springing-up cannot be seen. However, the nip shape becomes a nip shape in which the edge part W2 is 1.8 mm wider than the central part W1, and the difference between W1 and W2 is too large. In accordance therewith, the image becomes a non-uniform image in which the glossiness of the central portion of the image is low. Conversely, if the inverse crown CR' is large, the nip shape which is appropriate and in which there are no paper wrinkles and trailing edge springing-up becomes a centrally convex shape in which the longitudinal direction central part is wider than the edge parts, and problems such as the fixing performance of the edge parts of the image deteriorates and the like arise.

In accordance with studies of the present inventors, in order to achieve uniformity of fixing performance and glossiness while reducing the occurrence of paper wrinkles and trailing edge springing-up, it has become understood that the absolute value of the difference of the nip width W1 of the central part and the nip width W2 of the edge part must be less than or equal to 0.5 mm.

Then, assuming that the inverse crown amount per unit length of the pressure roller 30 is cr' and the crown amount per unit length of the sliding part of the film guide member 16 is cr, $$1.00\times10^{-10}\leqq cr-4cr'\leqq4.0\times10^{-3}.$$

Assuming that the width of the longitudinal direction central part of the fixing nip part is W1, and the nip width of the edge part is W2, at the time of $-0.5(\text{mm})\leqq W2-W1\leqq0.5$ (mm), an image can be obtained in which paper wrinkles and trailing edge springing-up are not caused and also fixing performance and glossiness are uniform.

(Second Embodiment)

Figure 12:
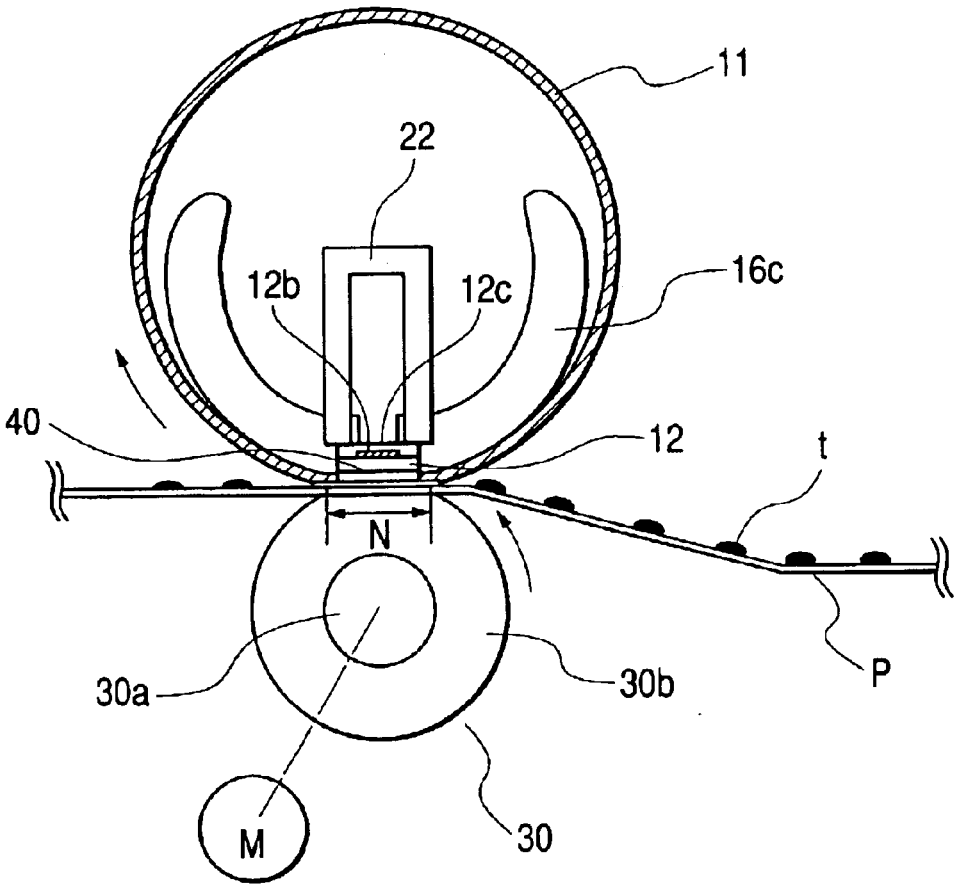
FIG. 12 is a view showing an image heating apparatus according to a second embodiment of the invention.

FIG. 12 is a cross-sectional model view of main portions of an image heating fixing apparatus of the present embodiment.

Reference numeral 16*c* is a heat-resistant/heat-insulating film guide which is shaped as a trough whose cross-section is substantially circular arc shaped. Reference numeral 12 is a ceramic heater serving as a heating body, and is fixed and supported by being fit into a groove portion which is formed and provided along the guide longitudinal direction at a substantially central part of the lower surface of the film guide 16*c*. In the present embodiment, the heater 12 corresponds to the sliding member.

Reference numeral 11 is a cylindrical or endless-shaped, and heat-resistant fixing film having a metal layer. The fixing film 11 is loosely fitted on the exterior of the film guide 16*c*.

As the base layer of the fixing film 11, by using a metal film having higher strength as the base layer, the rigidity of the fixing film 11 increases. Even when a large twisting force arises at the fixing film 11, it is difficult for the fixing film 11 to break, and the fixing film 11 of the present embodiment is suited to a high-speed and high-load fixing apparatus.

In the same way as in the first embodiment described above, when a metal film is used as the base layer, a resin layer such as polyimide or the like is preferably provided as a sliding layer at the inner surface of the fixing film 11. Further, a separating layer such as PFA resin having a good separating performance is preferably provided as a surface layer. Further, an elastic layer may be provided between the metal layer and the separating layer.

Moreover, by using a fixing film whose base layer is a metal film having high thermal conductivity, there is the merit that the heat generated at a heat generating body can be efficiently transferred to a paper. With respect to this point as well, the fixing film is suited to high speed printers in which it is easy for the temperature of the fixing film to drop due to continuous printing. As metal materials used therefor, Ni, SUS and the like are preferable.

Reference numeral 22 is a pressuring rigid stay which is inserted into the inner side of the film guide 16*c*.

Pressuring means for forming the fixing nip N and holding means for the edge parts of the fixing film are structured in the same way as in the first embodiment, and description thereof is omitted here.

The pressure roller 30 is rotation-driven in the counter-clockwise direction shown by the arrow by driving means M. Torque is applied to the fixing film 11 by frictional force between the pressure roller 30 and the outer surface of the fixing film 11 by rotation-driving of the pressure roller 30. While the inner surface of the fixing film 11 is sliding while closely contacting the lower surface (sliding surface) of the ceramic heater 12 at the fixing nip part N, the fixing film 11 is in a rotating state around the exterior of the film guide 16*c* at a peripheral velocity substantially corresponding to the rotating peripheral velocity of the pressure roller 30 in the clockwise direction shown by the arrow.

In the present embodiment as well, it is possible to obtain an image having uniform fixing performance and gloss without causing paper wrinkles and trailing edge springing-up at the recording material P, by combining a film guide 16*c* sliding surface shape and a pressure roller 30 shape which are structured in the same way as in the first embodiment, and which, assuming that the inverse crown amount per unit length of the pressure roller 30 is cr' and the crown amount per unit length of the sliding part of the film guide 16*c* is cr, $$1.00\times10^{-3} \leqq cr-4cr' \leqq 4.0\times10^{-3}, \text{ and}$$

assuming that the width of the longitudinal direction central part of the fixing nip is W1 and the nip width of the edge part is W2, $-0.5(\text{mm}) \leqq W2-W1 \leqq 0.5$ (mm).

In such a film heating system apparatus, a ceramic heater or an electromagnetic induction heat generating heater having a low heat capacity can be used as the heating body, and thin materials having a low heat capacity and heat resistance can be used as the film. As compared with a heat roller system apparatus using a fixing roller having a high heat capacity, there are the advantages that it is possible to markedly save power and shorten the waiting time, and there is a quick-start ability, and a rise in temperature at the interior of the apparatus can be suppressed, and the like.

(Other Embodiments)

1) The electromagnetic induction heat generating fixing film 10 may be a film in which the elastic layer 2 is omitted in a case in which the fixing film 10 is used for heat-fixing of a monochrome, one-pass multicolor image or the like. The heating layer 1 may be structured by mixing metal filler into a resin. The fixing film may be a member of a single layer which is a heating layer.

2) The image heating apparatus of the present invention is not limited to the image heat-fixing apparatus of the embodiments, and can be used as a means/apparatus broadly heat-processing a material to be heated, such as an image heating apparatus which modifies the surface properties such as gloss or the like by heating the recording material bearing the image, or an image heating apparatus temporarily fixing an image.

The present invention is not limited to the above-described examples, and includes modifications within the technical concept.

What is claimed is:

1. An image heating apparatus for heating an image formed on a recording material, comprising:

flexible rotating member;

sliding member, disposed at an interior of the flexible rotating member, for sliding with the rotating member; and a pressure roller for forming a nip part via the flexible rotating member together with sliding member, wherein a sliding surface of the nip part of the sliding member is crown shaped along a longitudinal direction of the sliding member, and the pressure roller is an inverse crown shape along the longitudinal direction, and between a crown amount cr per unit length of the crown shaped portion of the sliding member and an inverse crown amount cr per unit length of the pressure roller, there is the relationship:

$$1.00\times10^{-3} \leqq cr-4cr' \leqq 4.0\times10^{-3}.$$

2. An image heating apparatus according to claim 1, wherein between a width W1 of a longitudinal direction central part of the nip part and a width W2 at a position which is substantially toward an edge part 100 mm from the central part, there is the relationship:

$$-0.5(\text{mm}) \leqq W2-W1 \leqq 0.5(\text{mm}).$$

3. An image heating apparatus according to claim 1, wherein a linear pressure applied to the nip part is 60 g/mm to 180 g/mm.

4. An image heating apparatus according to claim 1, wherein a product hardness of the pressure roller in a molded state is Asker (TM) Durometer type C hardness (9.8 N load), and is 40°to 70°.

5. An image heating apparatus according to claim 1, wherein the flexible rotating member has a metal layer.

6. An image heating apparatus according to claim 5, further comprising:

magnetic field generating means, wherein the metal layer generates heat by effect of a magnetic field generated by the magnetic field generating means, and the image on the recording material is heated by the heat.

7. An image heating apparatus according to claim 5, wherein the sliding member is a heater which generates heat by energizing, and the image on the recording material is heated by the heat of the heater.

* * * * *

UNITED STATES PATENT AND TRADEMARK OFFICE

CERTIFICATE OF CORRECTION

PATENT NO. : 6,775,509 B2
DATED : August 10, 2004
INVENTOR(S) : Tomonori Shida et al.

It is certified that error appears in the above-identified patent and that said Letters Patent is hereby corrected as shown below:

Title page,
Item [56], References Cited, FOREIGN PATENT DOCUMENTS,
"09197864 A" should read -- 9-197864 A --; "11024478 A" should read -- 11-24478 A --; and "11249478 A" should read -- 11-249478 A --.

Column 3,
Line 48, "an" should read -- a --.

Column 5,
Line 14, "and" should read -- and upon --.

Column 7,
Line 60, "bottom" should read -- base --.

Column 8,
Line 43, "a" should read -- σ --.

Column 9,
Lines 3, 4 and 46, "silicon" should read -- silicone --.
Line 22, "lager" should read -- larger --.
Line 45, "silicon" (both occurrences) should read -- silicone --.

Column 11,
Line 48, "Δdenotes" should read -- Δ denotes --.

Column 12,
Line 1, (Table), "railing" should read -- trailing --.

UNITED STATES PATENT AND TRADEMARK OFFICE

CERTIFICATE OF CORRECTION

PATENT NO. : 6,775,509 B2
DATED : August 10, 2004
INVENTOR(S) : Tomonori Shida et al.

It is certified that error appears in the above-identified patent and that said Letters Patent is hereby corrected as shown below:

Column 16,
Line 24, “cr” should read -- cr´ --.
Line 44, “40°to” should read -- 40° to --.

Signed and Sealed this

Eighteenth Day of January, 2005

JON W. DUDAS
*Director of the United States Patent and Trademark Office*